US006682385B2

(12) United States Patent
Atzen et al.

(10) Patent No.: US 6,682,385 B2
(45) Date of Patent: Jan. 27, 2004

(54) TOY BUILDING ELEMENT WITH TRANSVERASAL OPENINGS

(75) Inventors: Bent Atzen, Vejle (DK); Sten Schmidt, Grindsted (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 10/181,243

(22) PCT Filed: Jan. 10, 2001

(86) PCT No.: PCT/DK01/00013

§ 371 (c)(1),
(2), (4) Date: Oct. 1, 2002

(87) PCT Pub. No.: WO01/51157

PCT Pub. Date: Jul. 19, 2001

(65) Prior Publication Data

US 2003/0129918 A1 Jul. 10, 2003

(30) Foreign Application Priority Data

Jan. 11, 2000 (DK) ..... 2000 00034

(51) Int. Cl.[7] ..... A63H 33/08
(52) U.S. Cl. ..... 446/124; 273/156
(58) Field of Search ..... 446/104, 105, 446/108, 111, 112, 113, 114, 115, 116, 120, 124, 125; 273/156

(56) References Cited

U.S. PATENT DOCUMENTS 3,699,709 A * 10/1972 Schmidt ..... 46/29
3,999,350 A * 12/1976 MacKenzie ..... 52/633
6,461,215 B1 * 10/2002 Kunz et al. ..... 446/107

FOREIGN PATENT DOCUMENTS

| | | |
|---|---|---|
| CH | 496 456 | 11/1970 |
| DE | 3 306 887 | 8/1984 |
| GB | 2 058 590 | 4/1981 |
| WO | WO 99/47224 | 9/1999 |

* cited by examiner

*Primary Examiner*—Jacob K. Ackun
*Assistant Examiner*—Jamila Williams
(74) *Attorney, Agent, or Firm*—Pitney, Hardin, Kipp & Szuch LLP

(57) ABSTRACT

A toy building element comprising one or more first beam-like parts (23, 24) with a plane internal face and an external face, and one or more other beam-like parts (21, 22) with a plane internal face and an external face. The beam-like parts are assembled in at least one corner whereby two internal faces are caused to form an angle of less than 180° relative to each other. At least the first beam-like part (23, 24) is/are provided with an opening (7) that extends transversally thereto from the external face to the internal face, and the opening (7) is arranged so far towards the corner that the plane for the face of the plane internal face (4) of the second beam-like part (21, 22) intersects the opening in the plane for the face of the plane internal face (3) of the first beam-like part (23, 24). The plane internal face (4) of the second beam-like part (21, 22) is interrupted at a distance from the opening (7) whereby a clearance is provided around the opening (7) on the internal face of the first beam-like part.

6 Claims, 1 Drawing Sheet

TOY BUILDING ELEMENT WITH TRANSVERASAL OPENINGS

Figure 1:
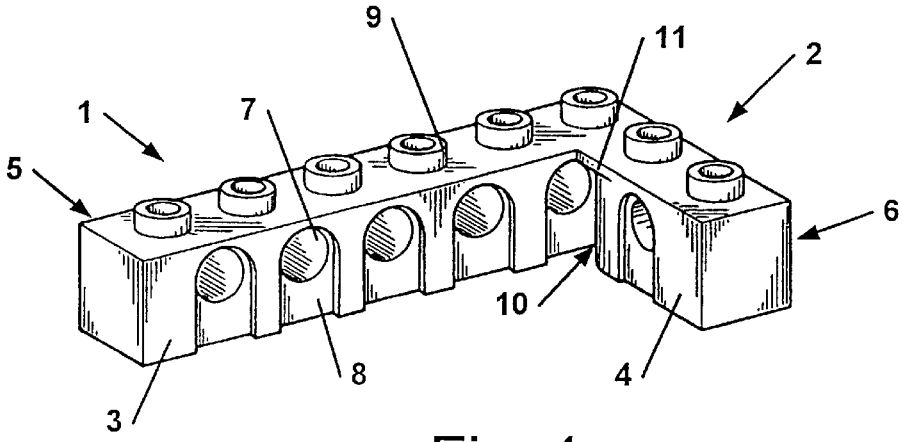

The invention relates to a toy building element comprising a first beam-like part with a plane internal face and an external face, and a second beam-like part with a plane internal face and an external face, said beam-like parts being assembled at a corner whereby the two internal faces are caused to form an angle of less than 180° relative to each other, wherein at least the first beam-like part is provided with an opening that extends transversally thereto from the external face to the internal face.

Such toy building element is known from the toy building set known under the name of LEGO Technic. This toy building set contains ia toy building elements in the form of straight beams provided with a number of openings that extend from the one side of the beam to the other. The toy building set also comprises toy building elements that consist of two beams that are assembled in a corner, wherein each of the beams is provided with at least one opening that extend(s) transversally of that beam. On their top faces, the toy building elements are provided with decored coupling studs, ie coupling studs that are configured as cylindrical pipes, whereas the bottom faces of the beams are provided with complementary coupling means in the form of outer skirts and, interiorly thereof, with downwardly protruding cylindrical studs.

Circular indentations are arranged around the openings to both sides of the beams, and such indentations serve to provide space for outwardly protruding collars on bushings that are also constituents of the toy building set and that can also be used to interconnect the beams or connect them with other toy building elements in the toy building set.

In case there are provided more openings in the same beam, they are arranged at a modular distance from each other, ie at the same distance from each other as the coupling studs on the top face of the beam. In practice, the openings are arranged centrally between the locations of the coupling studs.

In case of an angular element, ie a toy building element with two beam-like parts that are assembled at a corner, it is limited how far towards the corner an opening can be provided before it collides with the internal face of the other beam within the corner.

It is the object of the invention to provide a toy building element as featured above, in which toy building element an opening is provided further towards the corner than was previously known.

This is obtained by configuring the toy building element such that the opening is arranged so far towards the corner that the plane for the face of the plane internal face of the second beam-like part intersects the opening in the plane for the face of the plane internal face of the first beam-like part, and that the plane internal face of the second beam-like part is interrupted at a distance from the opening whereby a clearance is provided around the opening on the internal face of the first beam-like part.

By configuring the toy building element in this manner, additional play/building options are accomplished, since it is hereby possible to interconnect other toy building elements with the toy building element according to the invention further towards the corner than has been possible so far.

Preferably, the opening has a circular cross section and an indentation is provided around said opening on the external face as well as the internal face of the first beam-like part. It is the object of such indentation to provide space for outwardly protruding collars on eg bushings that are constituents of the toy building set.

Preferably, the indentation in the internal face of the beam-like part extends circularly around the one half of the opening and it continues around the remainder of the opening and out towards the edge at a width and a depth that correspond to the width and depth of the circular portion of the indentation. This configuration of the indentation is provided to avoid the need for providing decoring devices in the tool for the manufacture of the toy building element which would otherwise considerably increase the tool costs. This configuration is particularly advantageous in case of toy building elements with more beam-like parts that are angled relative to each other, since this would otherwise presuppose more decoring devices in various directions. The indentation has the shape of a roman arch around the opening that, besides adding to its functionality, also imparts thereto a harmonious appearance.

In a preferred embodiment the plane internal face of the second beam-like part is extended by an arched portion that arches inwards and collides with the plane internal face of the first beam-like part within the opening. Extension of the plane part with an arched part configured in this manner enables that the internal faces of the first and the second beam-like parts become coherent thereby imparting additional strength to the toy building element in its corner region compared to the case where the internal faces were not coherent.

According to a particular embodiment of a toy building element according to the invention, it comprises four beam-like parts that combine to form a closed frame, openings being provided in all of the beam-like parts. Since the invention makes it possible to provide openings close to the corners of the toy building elements, such frame element may be quite compact and yet be provided with comparatively many openings.

Preferably, the toy building element is provided with upwardly extending coupling studs and with downwardly extending skirts and pins that form coupling means that are complementary with the upwardly extending coupling studs which makes it compatible with other toy building elements in commonly available toy building sets.

Figure 2:
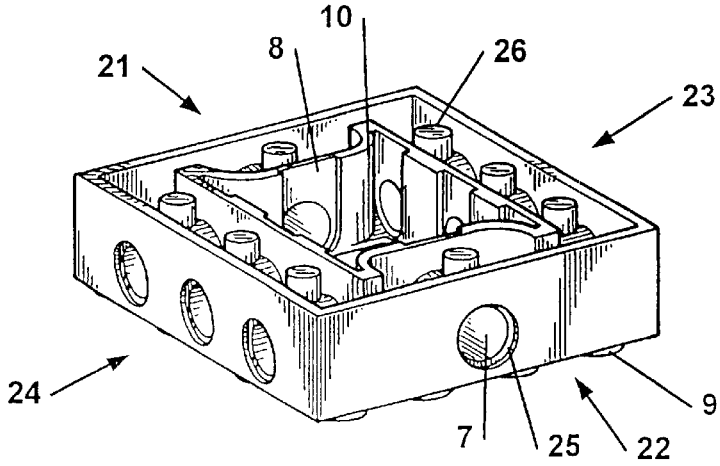
Figure 3:
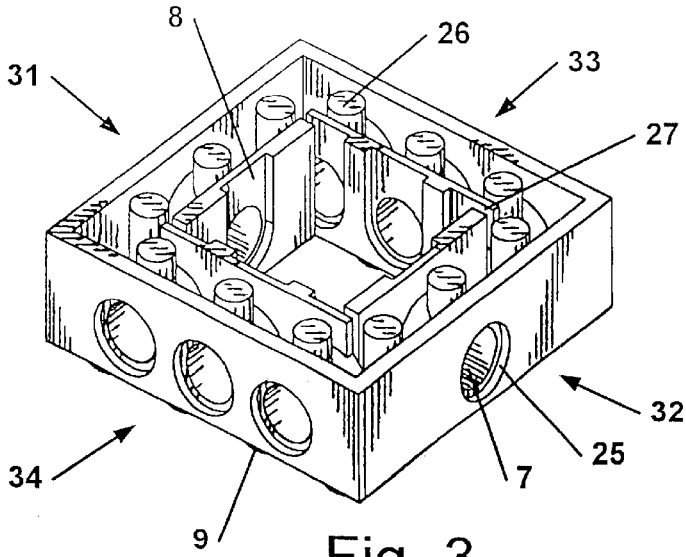

The invention will now be explained in further detail with reference to the drawings, wherein FIG. 1 is a top plan perspective view of a first toy building element according to the invention;

FIG. 2 is a bottom plan perspective view of a second toy building element according to the invention; and FIG. 3 is a bottom plan perspective view of a third toy building element according to the invention.

FIG. 1 shows a first toy building element according to the invention. The toy building element comprises two beam-like parts 1, 2, each of which having an internal face 3, 4 and an external face 5, 6. The external faces are not visible in FIG. 1.

The beam-like parts 1, 2 are also provided with openings 7 that are configured as cylindrical pipes that extend transversally to the beam-like parts 1, 2 from the external face 5, 6 to the internal face 3, 4. The first beam-like part 1 is provided with five such openings 7 while the second beam-like part 2 is provided with one opening 7.

The openings 7 are configured such that they are able to receive and snap-lockingly secure bushings that are provided in a toy building set of which the toy building elements are constituents. The bushings are tubular and provided with an outwardly extending collar that defines an end stop for the distance the bushing can be displaced into the opening 7. In the outer extremity of the bushing, a corresponding, outwardly extending collar is provided which is, however, configured to be resilient, the bushing being in this case slotted in the longitudinal direction. Thus the bushing can be pressed into an opening 7 with its outer end squeezed together until the end stop is reached. In this position, the outer end has reached the other side of the opening 7, and the outwardly extending collar engages behind the opening 7.

In order to allow space for the two outwardly extending collars of the bushing, without same extending beyond the internal and external faces 3, 4, 5, 6 of the toy building element, these internal and external faces are provided with indentations 8 that extend around the openings 7.

The indentations can be configured as circular indentations that extend around the openings 7 (as shown on the external faces of the toy building elements shown in FIGS. 2 and 3), their being configured with a depth that corresponds to or slightly exceeds the height of the outwardly extending collar of a bushing, and a diameter that corresponds to or slightly exceeds the outer diameter of the outwardly extending collar of a bushing.

Alternatively, the indentations 8 can be configured as shown on the internal faces 3, 4 of the toy building element shown in FIG. 1, ie as a combination of a rectangle and a semicircle that extends around the opening 7 and all the way to the edge of the internal face 3, 4. The indentations 8 serve to fulfil the same function as the above-mentioned circular indentations, viz to provide space for the outwardly extending collars of the bushings.

On its top face the toy building element is provided with upwardly extending coupling studs 9 that are, in the relevant case, decored, ie they each have the shape of a cylindrical pipe. The bottom of the toy building element is open (like the toy building elements shown in FIGS. 2 and 3) and by means of the external walls and downwardly extending pins they form coupling means that are complementary with the coupling studs 9.

The coupling studs 9 are arranged at a modular distance from each other which means that the toy building element is compatible with other toy building elements with coupling studs arranged at the same modular distance. In a corresponding manner the openings 7 are arranged at a modular distance from each other and in the specific case, the openings 7 are arranged between the coupling studs 9.

As will appear the one opening 7 in the first beam-like part 1 is arranged far towards the corner between the two beam-like parts 1, 2. This opening 7 is arranged so far towards the corner that normally it would collide with the internal face 4 of the second beam-like part. In order to prevent this from happening, the plane portion of the internal face 4 is interrupted at a distance from the internal face 3 whereby a clearance is provided around this opening 7.

In the toy building element shown in FIG. 1, the internal face 4 is extended by an arched part 10 that arches inwards and abuts on the plane internal face 3 of the first beam-like part 1 within the opening 7.

A thin flap 11 of material extends across the space between the arched portion 10 and the internal face 3, said flap on the one hand imparting strength to the toy building element and rigidity in the corner region, and on the other hides the space between the arched portion 10 and the internal face 3 when the toy building element is viewed from above.

FIG. 2 shows a further toy building element according to the invention. The toy building element shown comprises four beam-like parts 21, 22, 23, 24 that are each provided with one or more openings 7, and the four parts 21, 22, 23, 24 combine to form a closed frame element. In each of the beam-like parts 23, 24 three openings 7 are provided whereas the two remaining beam-like parts 21, 22 are each provided with one opening 7. The external faces of the beam-like parts 21, 22, 23, 24 are provided with circular indentations 25 around the openings 7 while the internal faces are provided with indentations 8 that are configured as a combination of a rectangle and a semicircle that extends around the opening 7 and all the way to the edge of the internal faces.

The toy building set shown in FIG. 2 is shown from the bottom, which is open, the internal and external walls of the toy building element combining with pins 26 to form coupling means that are complementary to the coupling studs 9 provided on the top face of the toy building element.

The corners of the toy building element are configured like the corner on the toy building element shown in FIG. 1, ie with arched portions 10 located in extension of the plane internal faces of the beam-like parts 21, 22. FIG. 2 clearly illustrates how the arched parts 10 abut on the internal faces on the adjacent beam-like parts 23, 24 within the openings.

All four corners being configured in this manner makes it possible to provide the toy building element shown with a total of eight openings 7 as shown despite its compactness.

FIG. 3 shows a further toy building element according to the invention with four beam-like parts 31, 32, 33, 34. Also in this toy building element, two beam-like parts 33, 34 are provided with three openings 7 while the two remaining beam-like parts 31, 32 are each provided with one opening 7. The external faces of the beam-like parts 31, 32, 33, 34 are provided with circular indentations 25 around the openings 7 whereas the internal faces are provided with indentations 8 that are configured as a combination of a rectangle and a semicircle that extends around the opening 7 and all the way to the edge of the internal faces.

The toy building element shown in FIG. 3 also has an open bottom, its internal and external faces combining with pins 26 to form coupling means that are complementary to the coupling studs 9 provided on the top face of the toy building element.

As opposed to the toy building elements described above, this toy building element is not provided with an arched extension on some of its internal faces. In contrast, the internal faces of the beam-like parts 31, 32 are merely interrupted at a distance from the openings 7 configured at the corners transversally to the beam-like parts 33, 34. Thus, a slot 27 is provided between the abutting internal faces, said slot 27 having a suitable width, eg at least corresponding to the height of a protruding collar on a bushing for the toy building set.

This arrangement, too, makes it possible to provide the toy building element shown with a total of eight openings 7 as shown despite its compactness.

What is claimed is:

1. A toy building element comprising a first beam part (1; 23, 24; 33, 34) with a plane internal face (3) and an external face (5), and a second beam part (2; 21, 22; 31, 32) with a plane internal face (4) and an external face (6), said beam parts being assembled in a corner whereby the two internal faces (3, 4) are caused to form an angle of less than 180° relative to each other, wherein at least the first beam part (1;23, 24; 33, 34) is provided with an opening (7) that extends transversally thereto from the external face (5) to the internal face (3), characterised in that the opening (7) is arranged so far towards the corner that the plane for the face of the plane internal face (4) of the second beam part (2; 21, 22; 31, 32) intersects the opening in the plane for the face of the plane internal face (3) of the first beam-like part (1; 23,

24; 33, 34); and that the plane internal face (4) of the second beam part (2; 21, 22; 31, 32) is interrupted at a distance from the opening (7), whereby a clearance is accomplished around the opening (7) of the internal face (3) of the first beam part.

2. A toy building element according to claim 1, characterised in that the opening (7) has a circular cross section; and that an indentation (8) is provided around the opening (7) in both the external face (5) and the internal face (3) of the first beam part.

3. A toy building element according to claim 2, characterised in that the indentation (8) in the internal face (3) extends circularly around the first half of the opening (7) and outwards towards the edge in a width and depth that correspond to the width and depth of the circular part of the indentation (8).

4. A toy building element according to claim 1, characterised in that the plane internal face (4) of the second beam part (2; 21, 22; 31, 32) is extended by an arched part (10) that arches inwards and abuts on the plane internal face (3) of the first beam part (3) within the opening (7).

5. A toy building element according to claim 1, characterised in that the toy building element comprises four beam parts (21, 22, 23, 24; 31, 32, 33, 34) that combine to form a closed frame; and that openings (7) are provided in all of the beam parts.

6. A toy building element according to claim 1, characterised in that the toy building element is provided with upwardly extending coupling studs (9) and with downwardly extending skirts and pins (26) that form coupling means that are complementary with the upwardly extending coupling studs (9).

* * * * *